US007397470B2

(12) United States Patent
Hata et al.

(10) Patent No.: US 7,397,470 B2
(45) Date of Patent: Jul. 8, 2008

(54) DISPLAY METHOD, DISPLAY CONTROLLER, AND DISPLAY APPARATUS

(75) Inventors: Ryouta Hata, Iizuka (JP); Jun Ikeda, Fukuoka (JP); Shuichi Ojima, Fukuoka (JP); Tsuyoshi Hirashima, Kasuya-Gun (JP); Shinya Kiuchi, Iizuka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 684 days.

(21) Appl. No.: 10/790,863

(22) Filed: Mar. 3, 2004

(65) Prior Publication Data

US 2004/0207609 A1 Oct. 21, 2004

(30) Foreign Application Priority Data

Mar. 5, 2003 (JP) ..... 2003-058516

(51) Int. Cl.
*G09G 5/00* (2006.01)

(52) U.S. Cl. ..... 345/204; 345/207; 345/211; 345/643

(58) Field of Classification Search ..... 345/102, 345/204, 9, 207, 75.2, 99, 92, 76, 87, 74.3, 345/1.1, 103, 100, 63, 90, 8, 84, 88, 89, 690, 345/211, 643; 315/169.3; 382/100, 284; 349/115, 1; 355/61; 359/487
See application file for complete search history.

(56) References Cited

U.S. PATENT DOCUMENTS 4,653,109 A * 3/1987 Lemelson et al. ..... 382/107
4,739,404 A * 4/1988 Richardson ..... 348/719
5,844,530 A * 12/1998 Tosaki ..... 345/8
5,892,573 A * 4/1999 Takahashi et al. ..... 355/61
6,008,786 A * 12/1999 Kimura et al. ..... 345/89
6,447,132 B1 * 9/2002 Harter, Jr. ..... 362/29
6,710,831 B1 * 3/2004 Winker et al. ..... 349/115
6,795,053 B1 9/2004 Funamoto et al.
6,888,524 B2 * 5/2005 Bayrle et al. ..... 345/88
6,903,716 B2 * 6/2005 Kawabe et al. ..... 345/99
7,034,820 B2 * 4/2006 Urisaka et al. ..... 345/419
7,161,576 B2 * 1/2007 Kawabe et al. ..... 345/99
7,199,776 B2 * 4/2007 Ikeda et al. ..... 345/89
7,245,308 B2 * 7/2007 Kiuchi et al. ..... 345/643

(Continued)

FOREIGN PATENT DOCUMENTS

CN 1304522 7/2001

(Continued)

*Primary Examiner*—Prabodh Dharia
(74) *Attorney, Agent, or Firm*—Wenderoth, Lind & Ponack, L.L.P.

(57) ABSTRACT

A display controller includes a video signal-analyzing unit, a video signal-adjusting unit operable to receive a video signal, to adjust the video signal in accordance with adjustment parameter information, and to feed the adjusted video signal into a display device, and a light source-controlling unit operable to feed a light source-controlling signal into a light source in accordance with light source light-emitting amount information. The video signal-analyzing unit allows timing in which the display device displays a picture in accordance with the adjusted video signal from the video signal-adjusting unit to be synchronized with timing in which the light source changes a light-emitting amount in response to the light source-controlling signal from the light source-controlling unit.

16 Claims, 6 Drawing Sheets

U.S. PATENT DOCUMENTS

| | | | | |
|---|---|---|---|---|
| 2002/0130830 | A1 | 9/2002 | Park | |
| 2002/0154404 | A1* | 10/2002 | Sedlmayr | 359/487 |
| 2003/0038886 | A1* | 2/2003 | Fujii et al. | 348/231.6 |
| 2003/0058229 | A1* | 3/2003 | Kawabe et al. | 345/204 |
| 2003/0179221 | A1* | 9/2003 | Nitta et al. | 345/690 |
| 2003/0201969 | A1* | 10/2003 | Hiyama et al. | 345/102 |
| 2003/0210222 | A1* | 11/2003 | Ogiwara et al. | 345/103 |
| 2004/0100437 | A1* | 5/2004 | Hunter et al. | 345/102 |
| 2005/0030379 | A1* | 2/2005 | Liuskin et al. | 348/148 |
| 2005/0093796 | A1* | 5/2005 | Fergason | 345/88 |
| 2006/0001658 | A1* | 1/2006 | Plut | 345/211 |
| 2006/0007363 | A1* | 1/2006 | Ozawa et al. | 349/1 |

FOREIGN PATENT DOCUMENTS

| | | |
|---|---|---|
| EP | 1 091 341 | 4/2001 |
| EP | 1 111 578 | 6/2001 |
| JP | 05-066501 | 3/1993 |
| JP | 2002-365611 | 12/2002 |

* cited by examiner

DISPLAY METHOD, DISPLAY CONTROLLER, AND DISPLAY APPARATUS

BACKGROUND OF THE INVENTION

1. Field of the Invention

The present invention relates to a display method, a display controller, and a display apparatus. In particular, it relates to an art of dynamically adjusting a video signal and light source luminance in accordance with entered video data in a video-displaying apparatus that is operable to display a picture by illuminating, with light from a light source, a light-receiving display device as represented by a liquid crystal panel.

2. Description of the Related Art

In order to provide a light source with less power consumption and a longer life display device, a video signal-adjusting value and a light source luminance-regulating value have been controlled in a manner correlated therebetween in response to an entered video signal, a photosensor, and a temperature sensor, thereby realizing a power saving and a longer lifetime in the display device. Such a prior art is disclosed in published Japanese Patent Application Laid-Open No. 5-66501.

However, according to the prior art, a step of displaying an adjusted video signal on a display device is entirely unassociated in terms of time with a step of switching a light source to a value at which the luminance of the light source has been regulated.

As a result, despite an earnest effort to closely adjust the video signal to be applied to the display device, the video signal is often unbalanced with a light-emitting amount of the light source. More specifically, the prior art sometimes results in unsuccessful display such as an obscure image plane and a conspicuous change between brighter and darker light sources.

OBJECTS AND SUMMARY OF THE INVENTION

In view of the above, an object of the present invention is to provide a display method operable to provide improved display quality, and an art related thereto.

A first aspect of the present invention provides a display method comprising: using a display device operable to display a picture on the display device in accordance with a video signal; using a light source operable to illuminate the display device with a light in response to a light source-controlling signal; and synchronizing the timing at which the display device displays the picture with the timing at which the light source changes a light-emitting amount.

The above system eliminates staggering between the timing at which the display device displays the picture and the timing at which the light source changes the light-emitting amount, thereby suppressing staggering-caused degradation in image quality, with consequential high-quality display results.

A second aspect of the present invention provides a display method as defined in the first aspect of the present invention, wherein the timing at which the light source changes the light-emitting amount is matched with the timing at which the display device renews a half of an image plane.

The above system maintains an invariably proper relationship between the display on the display device and the light-emitting amount of the light source. This feature provides improved display quality.

A third aspect of the present invention provides a display method as defined in the first aspect of the present invention, wherein the synchronizing is performed in response to a Vsync-signal from the display device.

The above system provides synchronizing control in timing dependant upon the Vsync-signal.

A fourth aspect of the present invention provides a display method as defined in the first aspect of the present invention, wherein the synchronizing is adjusted in timing in accordance with at least one of a period of time in which the video signal is transferred to the display device and a period of time in which the display device responds.

A fifth aspect of the present invention provides a display method as defined in the first aspect of the present invention, wherein the synchronizing is adjusted in timing in accordance with temperature information detected by a temperature sensor.

The adjustment as discussed above provides higher-precision synchronization, thereby providing improved display quality.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 6(*b*) is a graph illustrating the twist properties of liquid crystal according to the second embodiment; and FIG. 6(*c*) is a graph illustrating the twist properties of liquid crystal according to the second embodiment.

DETAILED DESCRIPTION OF THE PREFERRED EMBODIMENTS

Embodiments of the present invention are now described with reference to the accompanying drawings.

First Embodiment

Figure 1:
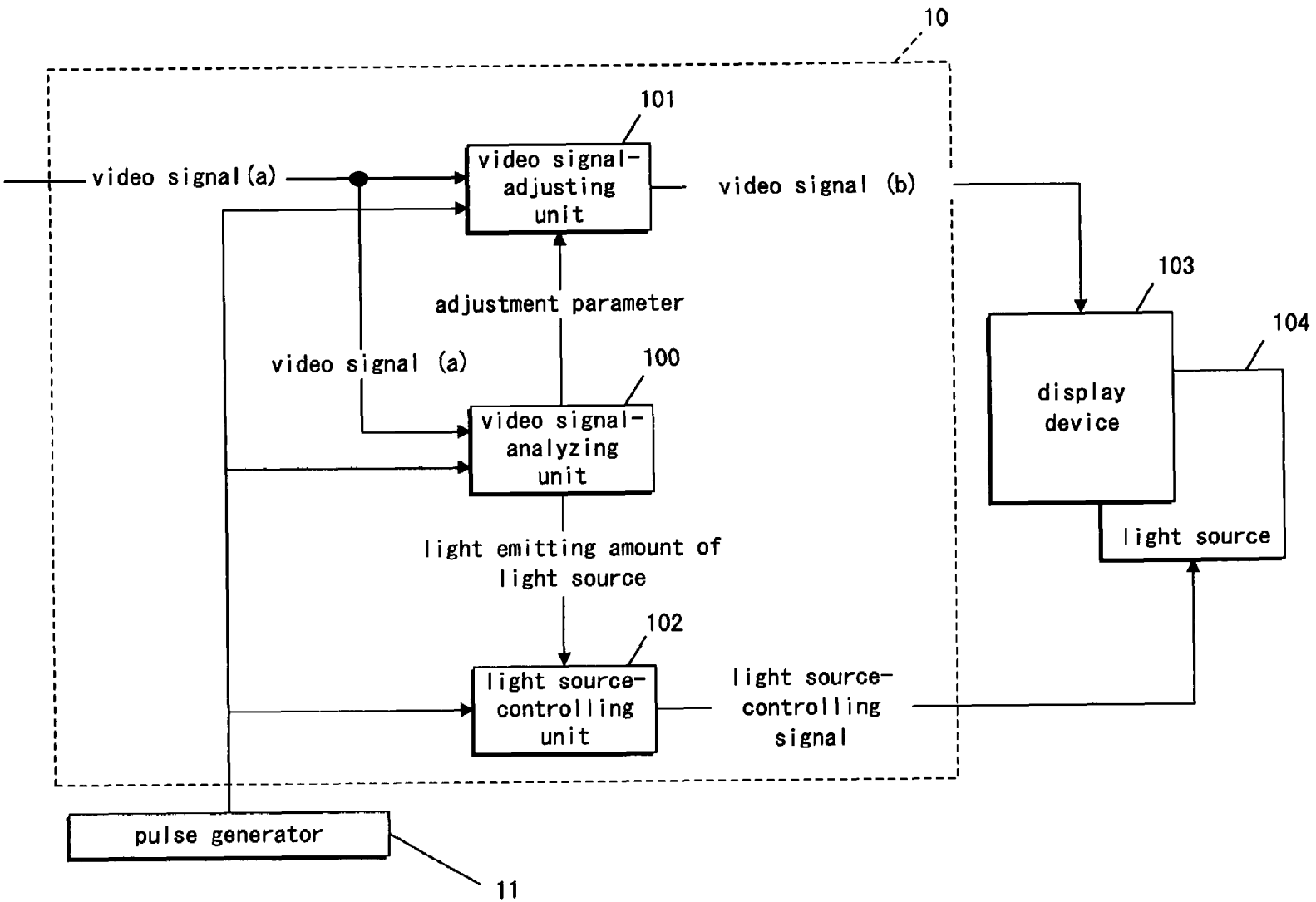
FIG. 1 is a block diagram illustrating a display apparatus according to a first embodiment of the present invention.

FIG. 1 is a block diagram illustrating a display apparatus according to a first embodiment of the present invention. As illustrated in FIG. 1, the display apparatus includes a display controller 10, a display device 103, and a light source 104 connected to the display device 103.

The display apparatus is of a light-receiving type, and the display device 103 is typically represented by a liquid crystal panel. The display apparatus includes a liquid crystal monitor, a liquid crystal television set, a liquid crystal projector, and a liquid crystal rear projector.

As illustrated in FIG. 1, the display controller 10 includes components as given below. More specifically, a video signal enters a video signal-analyzing unit 100, in which the video signal is analyzed; the video signal-analyzing unit 100 feeds adjustment parameters and a light source light-emitting amount into a video signal-adjusting unit 101 and a light source-controlling unit 102, respectively.

Pursuant to the present embodiment, the video signal-analyzing unit 100 extracts the maximum luminance of the entered video signal as a video feature parameter using a low pass filter or histogram, and determines the adjustment parameters in accordance with the video feature parameter. Alternatively, the video signal-analyzing unit 100 may take, as the video feature parameter, another index of brightness to be related to a light-emitting amount of the light source 104. To extract the maximum luminance of the entered video signal, any method is selectable as long as the selected method is operable to extract the maximum luminance.

The video signal enters the video signal-adjusting unit 101, in which the entered video signal is adjusted in accordance with information on the adjustment parameters from the video signal-analyzing unit 100. The adjusted video signal is fed from the video signal-adjusting unit 101 into the display device 103.

The light source-controlling unit 102 generates a light source-controlling signal in accordance with a light source light-emitting amount from the video signal-analyzing unit 101. The light source-controlling signal is fed from the light source-controlling unit 102 into the light source 104.

The system of FIG. 1 controls a timing for the video signal adjustment dependant upon the entered video signal and a timing for changing light-emitting amount of the light source 104.

More specifically, in response to certain pulses from a pulse generator 11, the video signal-analyzing unit 100 synchronizes timing in which the display device 103 displays a picture based on the adjusted video signal from the video signal-adjusting unit 101, with timing in which the light source 104 changes a light-emitting amount in response to the light source-controlling signal from the light source-controlling unit 102.

To adjust the light source 104 and the display of the picture on the display device 103, there has been a practice according to the prior art. More specifically, when the maximum luminance of the entered video signal has a value of, e.g., 80%, then a light source light-emitting amount and the transmissivity of a display device are adjusted to be 100% and 80%, respectively. In this way, the picture is displayed on the display device.

However, the display apparatus according to the present embodiment is primarily operable to regulate a light-emitting amount of the light source 104 in accordance with the maximum luminance of the entered video signal, and to adjust the transmissivity of the display device 103 in accordance with the regulated light-emitting amount. When the maximum luminance of the entered video signal has a value of, e.g., 80%, then the display apparatus according to the present embodiment adjusts the light-emitting amount of the light source 104 and the transmissivity of the display device 103 to be 80% and 100%, respectively.

This feature limits the light-emitting amount of the light source 104 to constrain power consumption, and provides successful display results.

Pursuant to the present embodiment, two different timings as described above are synchronized with one another, thereby providing improved display quality. More specifically, the video signal-analyzing unit 100 matches the timing at which the light source 104 changes the light-emitting amount with the timing at which the display device 103 renews a half of an image plane.

Figure 2:
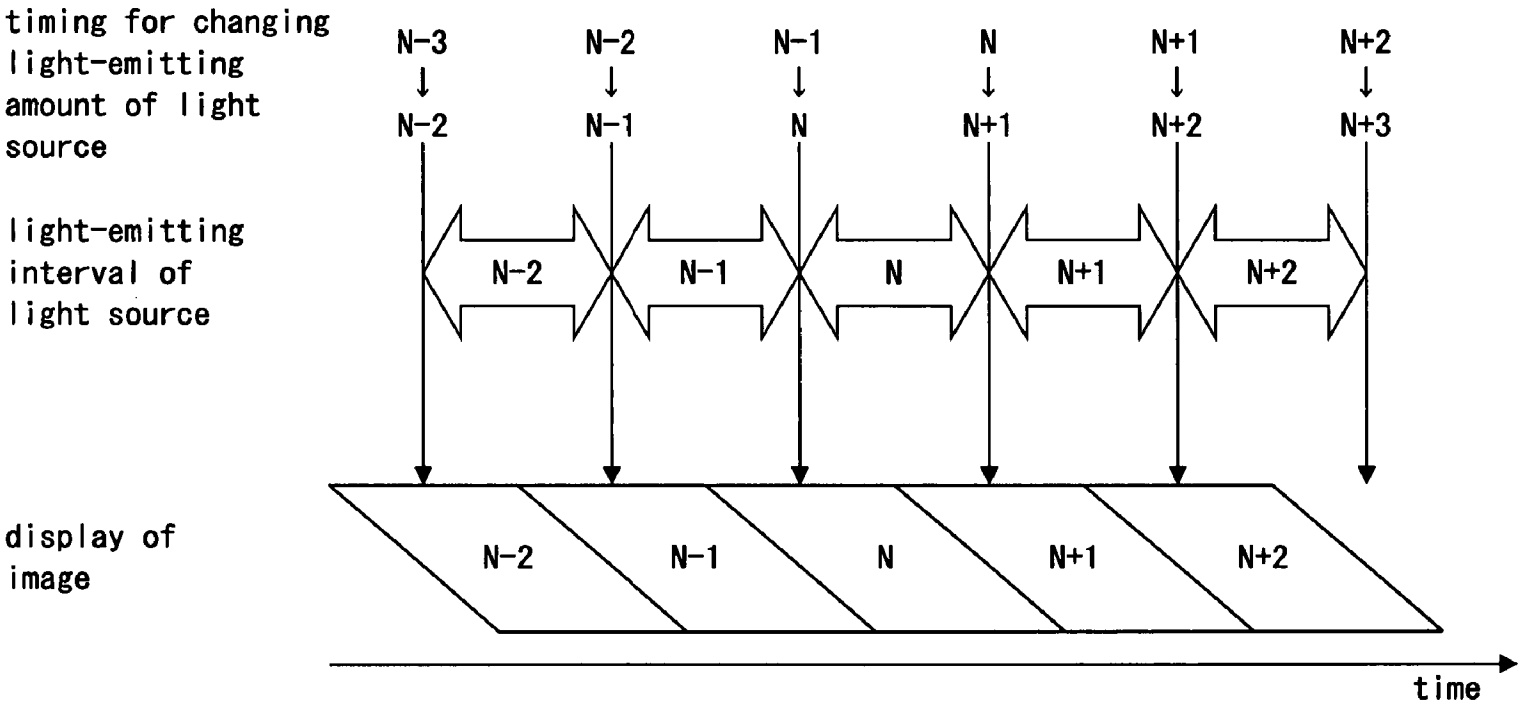
FIG. 2 is a time chart according to the first embodiment.

The following discusses the timing with reference to FIG. 2. As illustrated in FIG. 2, to renew a picture on the display device 103 for each line, the picture is renewed from the top of the display device 103 to the bottom thereof. When the display of an image plane or a frame is terminated, then the next picture appears from the top of the display device 103. To renew a picture on the display device 103 for each pixel, the picture is renewed from an upper-left portion of the display device 103 to a lower-right portion thereof.

To display a frame "N" on the display device 103, the light source 104 may be changed in light-emitting amount to a level adapted for the "N"-frame, exactly at an intermediate point between the moment when renewal from a "N−1" frame to the "N"-frame starts and the moment the renewal ends.

After the change in light-emitting amount, light having a light-emitting amount suited for the "N" frame is emitted from the light source 104 exactly at an intermediate point between the moment when the next renewal from the "N"-frame to a "N+1" frame starts and the moment the renewal ends.

The above-described system maintains an invariably proper relationship between the display of the video signal on the display device 103 and a change in light-emitting amount of the light source 104. This feature provides high-quality video display.

The present invention does not always adhere to the restriction in which the timing where the light source 104 renews the light-emitting amount must be consistent with the timing where the display device 103 renews a half of the image plane. The present invention is susceptible to numerous variations and modifications within a range in which the image plane is held in a proper relationship with the light-emitting amount.

Second Embodiment

A second embodiment is now described with reference to FIGS. 3-6. The present embodiment is fundamentally similar in idea to the previous embodiment. The present embodiment is characterized by the use of a Vsync-signal or other adjustable signals, thereby allowing the timing at which a display device 103 displays a picture to be more accurately synchronized with the timing at which a light source 104 changes a light-emitting amount.

Figure 3:
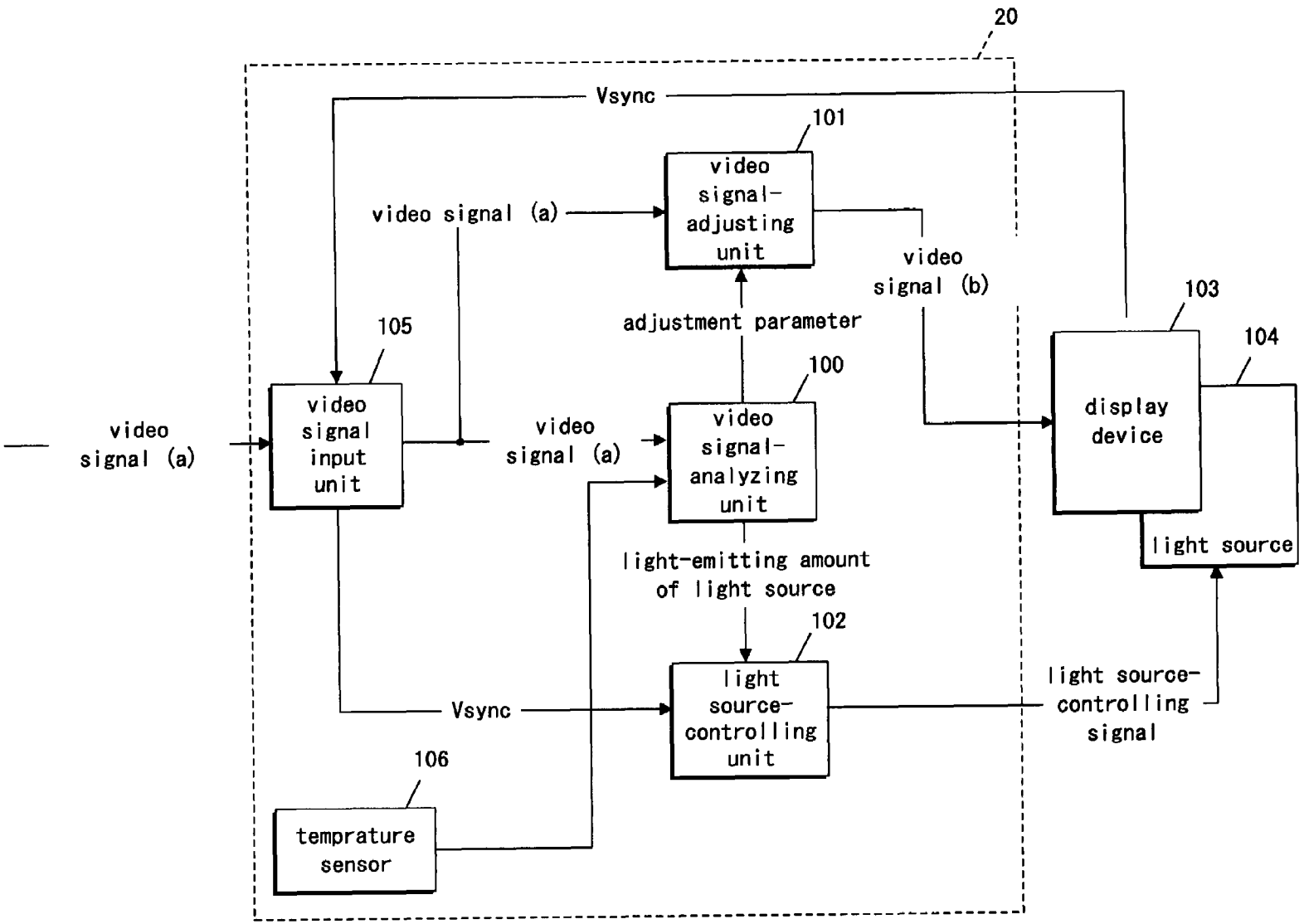
FIG. 3 is a block diagram illustrating a display apparatus according to a second embodiment.

FIG. 3 is a block diagram illustrating a display apparatus according to the present embodiment. The following description focuses primarily on differences between the present embodiment and the previous embodiment.

A display controller 20 according to the present embodiment includes a video signal input unit 105 and a temperature sensor 106 other than components of FIG. 1.

The temperature sensor 106 detects ambient temperature, and feeds the temperature information into a video signal-analyzing unit 100.

The video signal input unit 105 feeds an entered video signal into a video signal-adjusting unit 101 and the video signal-analyzing unit 100.

The video signal input unit 105 is connected to the display device 103, and receives the Vsync-signal from the display device 103. The received Vsync-signal is fed from the video signal input unit 105 into a light source-controlling unit 102.

The present embodiment differs from the previous embodiment in terms of the way in which the video signal-analyzing unit 100 synchronizes the timing where the display device 103 displays a picture with the timing where the light source 104 changes a light-emitting amount. More specifically, the video signal-analyzing unit 100 synchronizes those two different timings with one another in response to the Vsync-signal from the display device 103.

The video signal-analyzing unit 100 adjusts synchronous timing in accordance with transfer time in which a video signal is transferred from the video signal-adjusting unit 101 to the display device 103 and response time in which the display device 103 responds.

The following provides further detailed descriptions with reference to specific examples. The examples given below presuppose that the display device 103 is a liquid crystal panel.

EXAMPLE NO. 1

Figure 4:
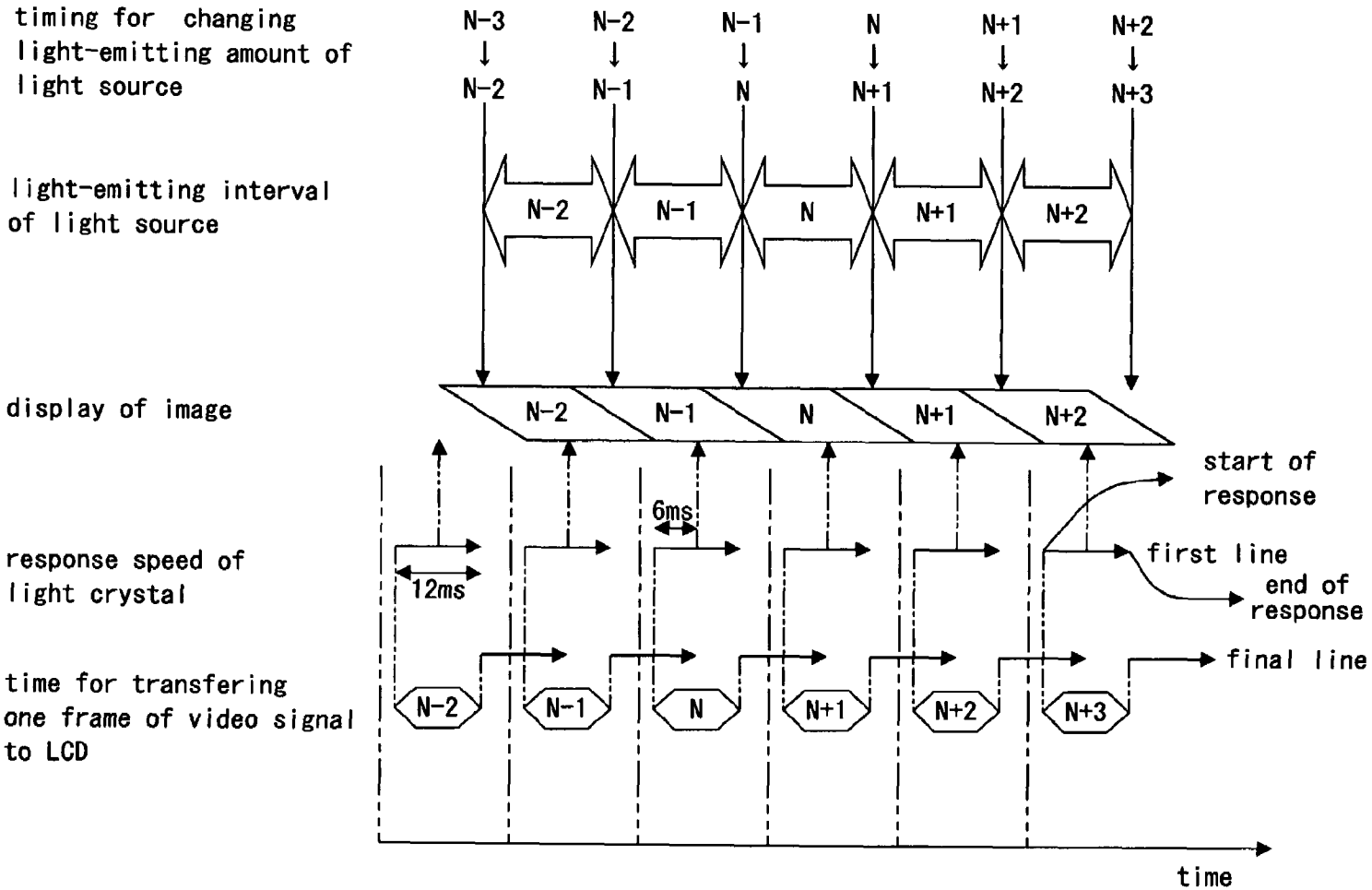
FIG. 4 is a time chart according to the second embodiment.

Example No. 1 is now described with reference to FIG. 4. The present example as illustrated in FIG. 4 presupposes that the Vsync-signal has a period of 60 Hz, liquid crystal has a response speed of 12.0 ms, the video signal-adjusting unit 101 transfers a video signal to the display device 103 for a transfer time of 10 ms, and the light source 104 has a response speed of 1 ms or less.

More specifically, the video signal starts to be transferred, in synchronism with the Vsync-signal, from the video signal-adjusting unit 101 to the display device 103 for each line. It takes 10 ms to complete the transfer at the final line.

Assume that the liquid crystal of the display device 103 starts a response immediately after the receipt of the video signal for each line. At the first line, a response ends when 12 ms elapses from the start of the transfer of the video signal. At the last line, a response ends when 22 ms (=10 ms+12 ms) elapses from the start of the transfer of the video signal.

Assume that an image plane starts being renewed exactly at an intermediate point between the moment when a video signal at the first line starts being transferred and the moment when a response at the first line ends. Assume that the renewal of the image plane ends exactly at an intermediate point between the moment when a video signal at the last line starts being transferred and the moment when a response at the last line ends.

The light source-controlling unit 102 may allow the light source 104 to emit a light in synchronism with the above timing; the emitted light has a light-emitting amount suited for an image of a frame "N".

For example, assume that a period of time "Rs" elapses from the Vsync-signal to a time when a video signal starts being transferred to the display device 103, that a video signal for an image plane is transferred to the display device 103 for a transfer time "Rt", and that the liquid crystal responds at a response speed of "LCt". As a result, timing "Tn" in which the light source 104 changes a light-emitting amount with reference to an image of the frame "N" is obtained by the following equation:

$$Tn=Rs+LCt/2+Rt/2$$

For Rs=2 ms, LCt=12 ms, and Rt=10 ms, at a time "Tn" (=13 ms) from the Vsync-signal, the video signal-analyzing unit 100 controls the light source-controlling unit 102 to permit the light source-controlling unit 102 to change a light-emitting amount of the light source 104 to a degree suited for the image of the frame "N".

When the liquid crystal of the display device 103 starts a response behind time after the receipt of a video signal for each line, then such delayed time is added to the timing "Tn" to handle the delayed time. The way in which an image plane is renewed may be varied freely as long as the image plane renewal is held in a proper relationship with the light-emitting amount.

EXAMPLE NO. 2

Example No. 2 is now described with reference to FIG. 5. The present example as illustrated in FIG. 5 presupposes that the light source 104 has a response speed of 1 ms or greater (e.g., 4 ms).

Figure 5:
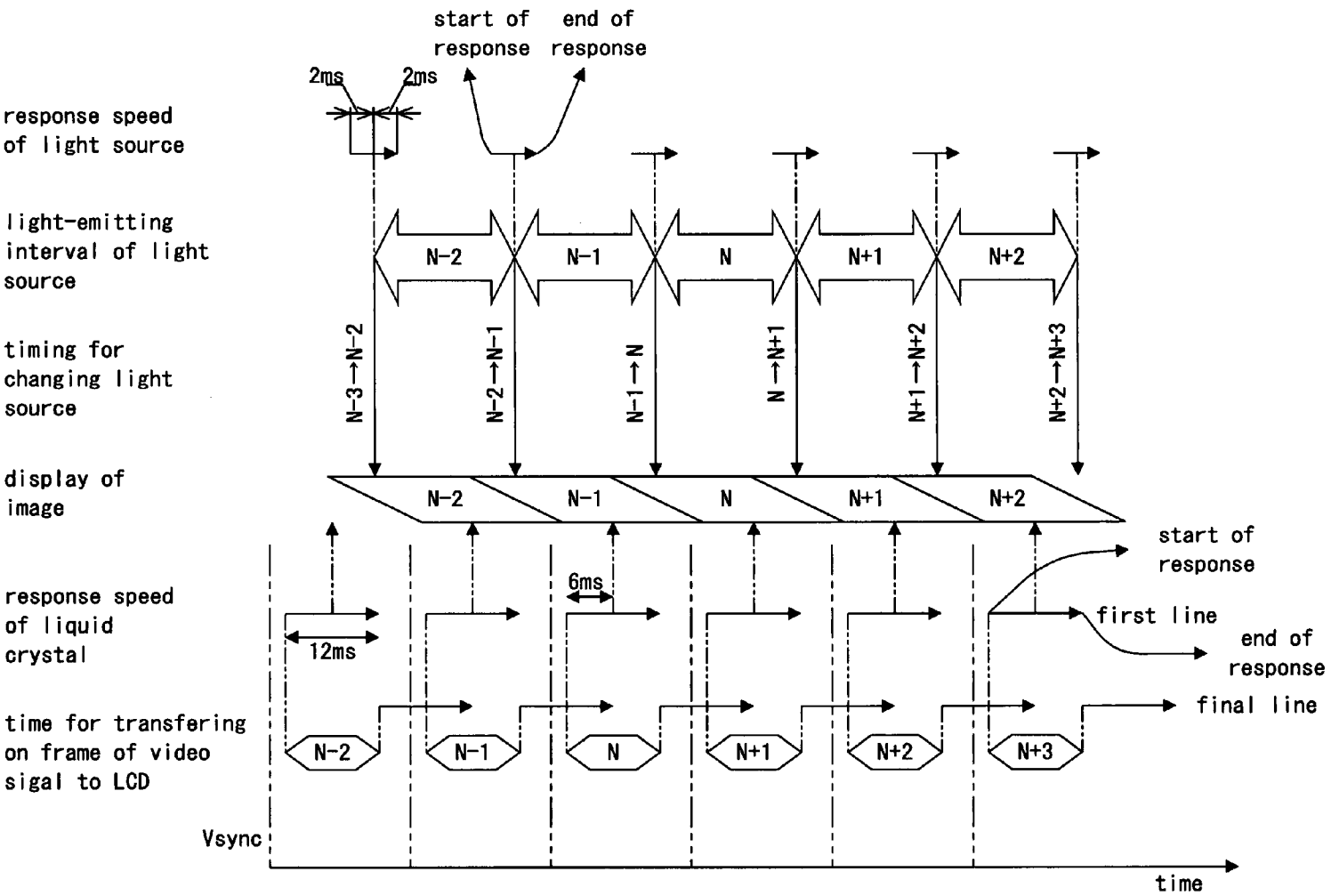
FIG. 5 is a time chart according to the second embodiment.

As illustrated in FIG. 5, the video signal-analyzing unit 100 controls the video signal-adjusting unit 101 and the light source-controlling unit 102 in such a manner that the moment when a response from the light source 104 reaches a halfway of a target is consistent with the moment when the image plane on the display device 103 reaches a half of renewal. The half of the renewal of the image plane refers to an exactly intermediate point between the moment when an "N"-frame starts being replaced by a "N+1" frame and the moment the replacement ends.

Example No. 1 or 2 maintains an invariably appropriate relationship between the Vsync-signal, the transfer of the video signal to the display device 103, a response speed of the liquid crystal, a response speed of the light source 104, the display of the video signal on the display device 103, and a change in light-emitting amount of the light source 104. This feature provides high-quality display results.

Figure 6A:
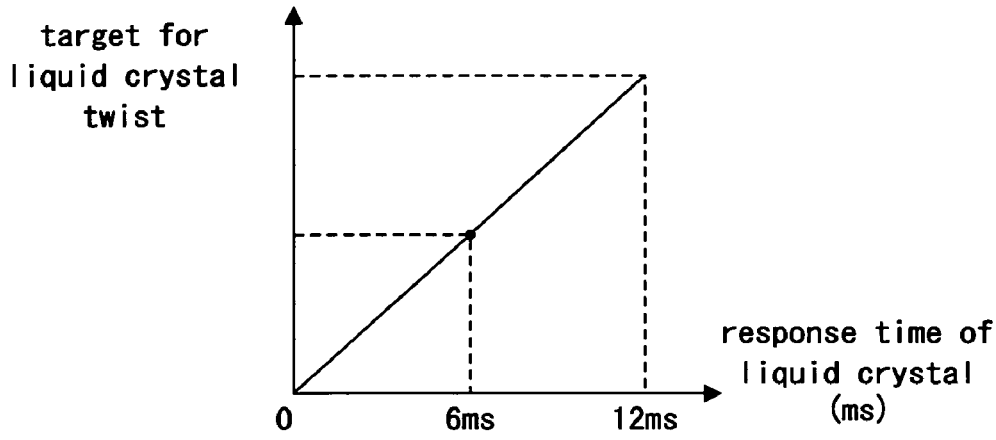
FIG. 6(*a*) is a graph illustrating the twist properties of liquid crystal according to the second embodiment.
Figure 6B:
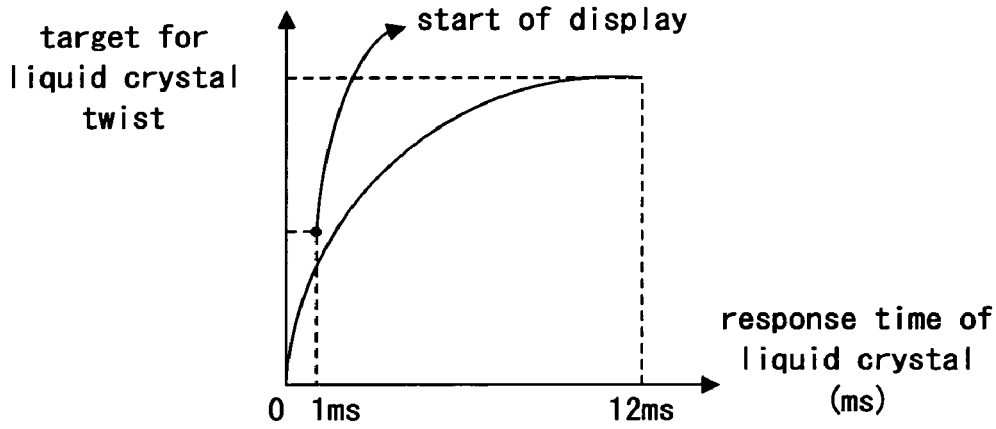
Figure 6C:
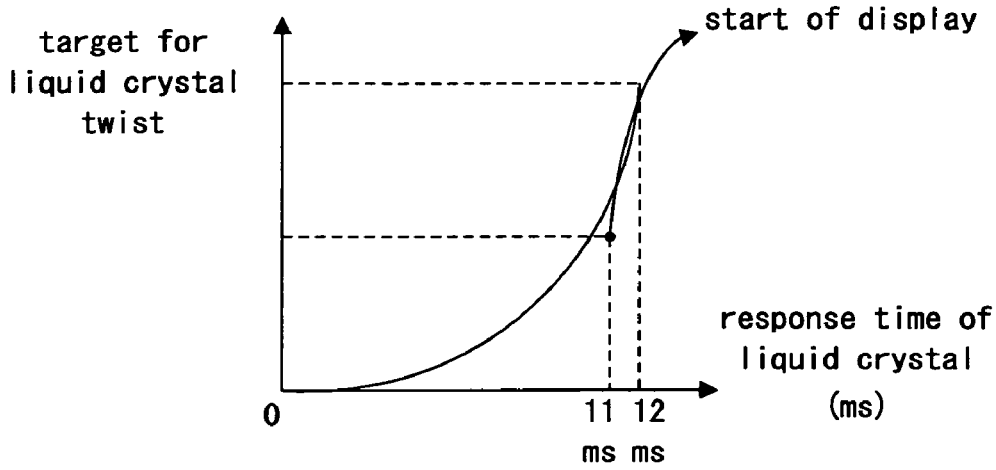

In general, it is unusual that the twist of the liquid crystal against a response time brings about linear characteristics, as illustrated in FIG. 6(*a*).

In fact, there are many cases where the twist of the liquid crystal results in non-linear characteristics as illustrated in FIG. 6(*b*). At any rate, it is advisable that the timing is controlled in accordance with the moment when the twist of the liquid crystal reaches a halfway of a target.

Such timing may be finely adjusted by repeated estimation or subjective assessment after being set in accordance with the above calculation.

When the display device 103 fails to feed the Vsync-signal, then the timing in which the light source 104 changes a light-emitting amount may be controlled in accordance with the timing in which the video signal-adjusting unit 101 transfers a video signal to the display device 103. The Vsync-signal may alternatively be fed from the video signal input unit 105, or the video signal-adjusting unit 101, or other components not illustrated in FIG. 3. In this alternative, the display device 103 displays a picture in synchronism with the Vsync-signal.

A buffer operable to store data represented by an image plane is desirably provided between the video signal input unit 105 and the video signal-adjusting unit 101. The use of the buffer provides delayed display on the image plane, and facilitates the synchronization with the Vsync-signal as discussed above.

Alternatively, without the buffer, adjustment parameters determined by the video signal-analyzing unit 100 in accordance with the frame "N" are reflected in the display of the frame "N+1". As a result, the light source 104 emits a light in accordance with timing in which the frame "N+1" is displayed on the display device 103; the emitted light has a light source light-emitting amount that is determined by the video signal-analyzing unit 100 based on the frame "N".

In addition, adjustment No. 1 and 2 as described below are carried out. Both of adjustment No. 1 and 2 are desirably performed to provide high-precision synchronization. Alternatively, either adjustment No. 1 or No. 2 may be omitted.

(Adjustment No. 1) In consideration of the transition of a video signal, the video signal-analyzing unit 100 adjusts synchronous timing in accordance with the transfer time in which the video signal is transferred to the display device 103 from the video signal-adjusting unit 101, and the response time of the display device 103.

The response speed of the liquid crystal is varied in accordance with a value of a presently displayed video signal, a value of the next video signal to be displayed, or the magnitude of a difference between those video signal values.

The response speed of the liquid crystal differs between, e.g., transition 1 (from black (R:G:B=0:0:0) to white (R:G:B=255:255:255)) and transition 2 (from dark gray (R:G:B=100:100:100) to bright gray (R:G:B=150:150:150).

More specifically, transition 1 provides a greater difference in video signal than transition 2 does, but results in greater response speed than transition 2 does.

Pursuant to the present embodiment, to handle such characteristics of the liquid crystal, the video signal-analyzing unit 100 extracts the maximum and minimum luminance of an entered video signal within an image plane. The video signal-analyzing unit 100 employs, as feature parameters, a difference between the maximum and minimum luminance, a maximum luminance value, and a minimum luminance value, thereby determining adjustment parameters. The video signal-analyzing unit 100 controls the timing in which the light source-controlling unit 102 changes a light-emitting amount of the light source 104.

(Accelerating Change Timing)

In general, the liquid crystal responds at high speeds when the maximum luminance has a value of either 255 (the maximum) or zero (the minimum). In this instance, the timing in which the light source 104 changes a light-emitting amount is set to be faster than the predetermined timing.

(Suppressing Change Timing)

When the previous frame "N−1" results in a very small level of the maximum luminance or a very dark image, and when the present frame "N" provides a very great level of the maximum luminance or a very bright image, then a light-emitting amount of the light source 104 can be changed from a small degree of a light-emitting amount adapted for the previous frame "N−1" to a great degree of a light-emitting amount suited for the present frame "N". In such change timing, a residual image sometimes appears because a response from the liquid crystal has not been completed. In particular, lower temperatures result in a slower response from the liquid crystal, and the residual image is rendered conspicuous. Accordingly, the timing in which the light source 104 changes a light-emitting amount is set to be slower than the predetermined timing when the previous frame "N−1" and the present frame "N" have a very small degree of the maximum luminance and a very great degree of the maximum luminance, respectively.

It is advisable that the timing in which the light source 104 changes a light-emitting amount is determined in accordance with a relationship between a video signal transitional pattern (typically, a maximum luminance transitional pattern) and a speed at which the liquid crystal responds.

Alternatively, the timing at which the light source 104 changes a light-emitting amount may be determined in accordance with the minimum luminance, or a difference between the maximum and minimum luminance, or variations in average luminance between frames, or visually noticeable variations in luminance signal at a certain region (e.g., a central portion) within an image plane.

(Adjustment No. 2) The video signal-analyzing unit 100 adjusts synchronous timing in accordance with information on temperature detected by the temperature sensor 106.

The liquid crystal has a tendency to decrease in response speed when ambient temperature decreases from an ordinary temperature to 0° C., −10° C., and −20° C.

To cope with such a tendency, the temperature sensor 106 measures the ambient temperature, and then feeds the temperature information into the video signal-analyzing unit 100. As a result, a change in characteristics of the liquid crystal due to the ambient temperature is reflected in conjunction with Adjustment No. 1. In addition, the timing in which the display device 103 displays a picture is more accurately synchronized with the timing in which the light source 104 changes a light-emitting amount.

In general, the response speed of the liquid crystal decreases with decrease in temperature, but increases with increase in temperature. When results from the detection of the temperature sensor 106 show that the ambient temperature is higher than an ordinary temperature (e.g., 20° C.), then the timing in which the light source 104 changes a light-emitting amount may preferably be set to be faster. In a converse case, the timing in which the light source 104 changes a light-emitting amount may preferably be set to be slower.

The way in which the response speed of the liquid crystal varies with a change in temperature depends upon a liquid crystal material and a mode (e.g., TN-mode). Accordingly, the timing in which the light source 104 changes a light-emitting amount may be set in accordance with properties of the liquid crystal in real use.

(Process at the Start of Control)

At the start of control, it is desirable to perform a different process than that at a steady state. A light source light-emitting amount may be adjusted to be a predetermined value immediately after the start of control (e.g., the first frame). Thereafter (e.g., the second frame and later), control over timing in which the light source light-emitting amount is changed may be started.

(Process at the End of Control)

The light source light-emitting amount is returned to the predetermined value at the end of control. At this time, a correlation between a video signal and the light source light-emitting amount is lost, and degradation in image quality is sometimes pronounced. Accordingly, the timing at which the light source light-emitting amount is returned to the predetermined amount may be adjusted in accordance with a video signal at the end of control. Alternatively, to suppress degradation in image quality, a frame to several frames may be displayed to reach the predetermined amount in stages. In this instance, the frames may be displayed in such a manner to gradually become either bright or dark.

Pursuant to the first and second embodiments, the video signal-analyzing unit 100 is operable to synchronize the timing in which the display device 103 displays a picture with the timing in which the light source 104 changes a light-emitting amount. Alternatively, the timings may be synchronized by the video signal-adjusting unit 101, or the light source-controlling unit 102, or other components not shown in FIGS. 1 and 3 (e.g., a synchronization control circuit or a CPU, which are to be additionally provided in the apparatus).

The first and second embodiments may be practiced in conjunction with a method operable to allow a video signal-adjusting value to be varied only within a certain range, or a method operable to allow a luminance-adjusting value of the light source 104 to be varied only within a certain range.

The present invention eliminates staggering between the timing in which the display device displays a picture and the timing in which the light source light-emitting amount is changed, and suppresses degradation in image quality. This feature provides successful display results.

The use of the Vsync-signal or the adjustment of another element provides accurate synchronization. This feature provides improved display quality.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A display method for use with a light source and a display device operable to display pictures in accordance with a video signal, said method comprising:

displaying pictures on the display device according to a display timing;

illuminating the display device with light from the light source in response to a light source-controlling signal;

regulating an amount of light emitted from the light source in accordance with a value of maximum luminance of the video signal, wherein the regulated amount of light includes 0%, 100% and a value therebetween;

changing the regulated amount of light emitted from the light source according to a light-change timing;

synchronizing the display timing with the light-change timing; and adjusting transmissivity of the display device in accordance with the regulated amount of light in a manner such that the transmissivity of the display device increases and the regulated amount of the light decreases.

2. A display method according to claim 1, wherein the light-change timing is matched with a timing at which the display device renews half of an image plane.

3. A display method according to claim 1, wherein said synchronizing is performed in response to a Vsync-signal from the display device.

4. A display method according to claim 1, wherein said synchronizing is adjusted in timing in accordance with at least one of a period of time in which the video signal is transferred to the display device and a period of time in which the display device responds to the video signal.

5. A display method according to claim 3, for use with a temperature sensor operable to detect temperature, wherein said synchronizing is adjusted in timing in accordance with the temperature detected by the temperature sensor, and wherein an interval from the Vsync-signal to when the amount of light begins to be changed changes in accordance with the temperature detected by the temperature sensor.

6. A display method according to claim 1, further comprising:

extracting a feature parameter of the video signal, wherein said synchronizing is adjusted in timing in accordance with the feature parameter.

7. A display controller for use with a display device and a light source, said display controller comprising:

a video signal-analyzing unit operable to receive and analyze a video signal, and to generate adjustment parameter information and light source light-emitting amount information;

a video signal-adjusting unit operable to receive the video signal, adjust the video signal in accordance with the adjustment parameter information from said video signal-analyzing unit, and to feed the adjusted video signal into the display device; and a light source-controlling unit operable to regulate a light-emitting amount of the light source in accordance with a value of maximum luminance of the video signal, and to feed a light source-controlling signal into the light source in accordance with the light source light-emitting amount information from said video signal-analyzing unit, the regulated light-emitting amount including 0%, 100% and a value therebetween, wherein said video signal-analyzing unit synchronizes a timing at which the display device is to display a picture based on the adjusted video signal from said video signal-adjusting unit, with a timing at which the light source is to change the regulated light-emitting amount in response to the light source-controlling signal from said light source-controlling unit, and wherein said video signal-adjusting unit adjusts transmissivity of the display device in accordance with the regulated light-emitting amount in a manner such that the transmissivity of the display device increases and the regulated light-emitting amount decreases.

8. A display controller according to claim 7, wherein said video signal-analyzing unit matches the timing at which the light source is to change the light-emitting amount with a timing at which the display device is to renew half of an image plane.

9. A display controller according to claim 7, wherein said video signal-analyzing unit synchronizes, in response to a Vsync-signal from the display device, the timing at which the display device is to display the picture with the timing at which the light source is to change the light-emitting amount.

10. A display controller according to claim 7, wherein said video-signal-analyzing unit adjusts synchronous timing in accordance with at least one of a period of time in which the video signal is transferred to the display device from said video signal-adjusting unit and a period of time in which the display device responds to the video signal.

11. A display controller according to claim 9, further comprising:

a temperature sensor operable to detect temperature, wherein said video signal-analyzing unit adjusts synchronous timing in accordance with the temperature detected by said temperature sensor, and wherein an interval from the Vsync-signal to when said light source controlling unit begins to change the amount of light changes in accordance with the temperature detected by said temperature sensor.

12. A display apparatus comprising:

a display device;

a light source; and a display controller comprising:

a video signal-analyzing unit operable to receive and analyze a video signal, and to generate adjustment parameter information and light source light-emitting amount information;

a video signal-adjusting unit operable to receive the video signal, adjust the video signal in accordance with the adjustment parameter information from said video signal-analyzing unit, and to feed the adjusted video signal into said display device; and a light source-controlling unit operable to regulate a light-emitting amount of the light source in accordance with a value of maximum luminance of the video signal, and to feed a light source-controlling signal into said light source in accordance with the light source light-emitting amount information from said video signal-analyzing unit, the regulated light-emitting amount including 0%, 100% and a value therebetween, wherein said video signal-analyzing unit synchronizes a timing at which said display device displays a picture based on the adjusted video signal from said video signal-adjusting unit, with a timing at which said light source changes the regulated light-emitting amount in response to the light source-controlling signal from said light source-controlling unit;

wherein said video signal-adjusting unit adjusts transmissivity of said display device in accordance with the regulated light-emitting amount in a manner such that the transmissivity of the display device increases and the regulated light-emitting amount decreases;

wherein said display device is operable to display a picture in accordance with the adjusted video signal that is fed from said video signal-adjusting unit of said display controller; and wherein said light source is operable to illuminate said display device with light in accordance with the light source-controlling signal that is fed from said light source-controlling unit of said display controller.

13. A display apparatus according to claim 12, wherein said video signal-analyzing unit matches the timing at which said light source changes the light-emitting amount with a timing at which said display device renews half of an image plane.

14. A display apparatus according to claim 12, wherein said video signal-analyzing unit synchronizes, in response to a Vsync-signal from said display device, the timing at which said display device displays the picture with the timing at which said light source changes the light-emitting amount.

15. A display apparatus according to claim 12, wherein said video-signal-analyzing unit adjusts synchronous timing in accordance with at least one of a period of time in which the video signal is transferred to said display device from said video signal-adjusting unit and a period of time in which said display device responds to the video signal.

16. A display apparatus according to claim 14, further comprising:

a temperature sensor operable to detect temperature, wherein said video signal-analyzing unit adjusts synchronous timing in accordance with the temperature detected by said temperature sensor, and wherein an interval from the Vsync-signal to when said light source-controlling unit begins to change the amount of light changes in accordance with the temperature detected by said temperature sensor.

* * * * *